US005906077A

United States Patent [19]

Andiarena

[11] Patent Number: 5,906,077

[45] Date of Patent: May 25, 1999

[54] ANCHORING DEVICE PARTICULARLY FOR UMBRELLAS

[76] Inventor: Oscar Andiarena, 12340 SW. 39th Terr., Miami, Fla. 33175

[21] Appl. No.: 08/821,108

[22] Filed: Mar. 20, 1997

[51] Int. Cl.[6] ..... E04H 15/62; E02D 5/74; A45F 3/44

[52] U.S. Cl. ..... 52/157; 52/156; 135/98; 135/118; 248/156; 248/508

[58] Field of Search ..... 248/156, 545, 248/508; 135/98, 118, 19.5, 15.1; 52/156, 157

[56] References Cited

U.S. PATENT DOCUMENTS

| | | | |
|---|---|---|---|
| 888,917 | 5/1908 | Lucas | 52/157 |
| 3,669,390 | 6/1972 | Hielson | 248/156 |
| 4,251,963 | 2/1981 | Patterson | 52/157 |
| 4,318,567 | 3/1982 | Guthier | 297/184 |
| 4,454,824 | 6/1984 | Wood | 109/52 |
| 4,753,411 | 6/1988 | Lechner et al. | 248/156 X |
| 4,819,904 | 4/1989 | Shpigel et al. | 248/545 |
| 4,832,304 | 5/1989 | Morgulis | 248/156 X |
| 4,850,564 | 7/1989 | Padin | 248/156 X |
| 4,863,231 | 9/1989 | Petersen | 135/98 |
| 4,923,165 | 5/1990 | Cockman | 248/156 X |
| 5,046,699 | 9/1991 | Perreault et al. | 248/156 X |
| 5,088,681 | 2/1992 | Procaccianti et al. | 248/156 X |
| 5,122,014 | 6/1992 | Genfan | 248/156 X |
| 5,135,192 | 8/1992 | Winkler | 248/156 |
| 5,139,219 | 8/1992 | Navarro | 248/97 |
| 5,152,495 | 10/1992 | Jacinto et al. | 248/156 X |
| 5,457,918 | 10/1995 | Plourde | 248/545 X |
| 5,482,246 | 1/1996 | Derkoski | 248/156 X |
| 5,524,855 | 6/1996 | Lesar | 248/530 |
| 5,662,304 | 9/1997 | McDaniel | 248/545 X |

*Primary Examiner*—Christopher Kent
*Assistant Examiner*—Brian E. Glessner
*Attorney, Agent, or Firm*—Womble Carlyle Sandridge & Rice, PLLC

[57] ABSTRACT

An anchoring device particularly for securement of an umbrella, and may also be used in soft or hard materials. The anchoring device is comprised of a tubular body having an outer surface and an upper end and a tapering lower end, the lower end includes a penetrating tip extending longitudinally from the tubular body, the penetrating tip further having a plurality of lateral extensions capable of breaking hard ground, and a plurality of laterally extending baffles about the outer surface of the lower end of the tubular body, each of the baffles having a front edge proximal and a rear edge distal to the lower end of the tubular body. The front edges are substantially the same distance from the penetrating tip, whereby the lateral extensions break the ground or material preceding the front edges of the baffles as the body rotates.

12 Claims, 3 Drawing Sheets

ANCHORING DEVICE PARTICULARLY FOR UMBRELLAS

BACKGROUND OF THE INVENTION

1. Field of the Invention

The present invention is an anchoring device for securement or support of articles in hard or soft materials. Many anchoring devices generally resemble "screws" as they have a spiraling thread about their lower ends which enters the ground, or into soft or hard materials, as the screws turns in such direction that the front edge of the thread is forced into the ground. Such method of securement either fastens the anchor within the ground so that an article may utilize the fastening force of the anchor to hold the article in the ground, or the anchor may support an article above the ground. The present invention is particularly applicable to support umbrellas over the ground, although it will be appreciated that the invention could advantageously be used for other ground-anchoring or fastening functions, including supporting pipes and cables, and the like.

2. Description of the Related Art

Prior art screws generally have one continuous spiraling thread about the lower end to enter and embed within the ground. As such, each rotation of the screw only further inserts into the ground an additional small part of the spiraling thread. Even with narrow thread pitch, prior art screws must be repeatedly rotated in order to functionally secure or support an article. Without either a deep penetration into the material or a significant lateral extension of the thread, the prior art screw may slip in softer material, such as beach sand.

A typical prior art anchoring device is shown in U.S. Pat. No. 4,832,304, to Morgulis. Morgulis teaches a ground anchoring devices particularly for umbrellas, which has a spiraling thread for threading into the ground. However, Morgulis only teaches a single spirally threaded screw for fastening the umbrella into the ground, not a plurality of discontinuous ridges as does the present invention. The Morgulis anchoring device must therefore be driven deeply into the ground to withstand the force of wind buffeting the umbrella. Otherwise, given the surface area of a umbrella, such significant force may easily dislodge an umbrella from beach sand.

Another prior art anchor is demonstrated in U.S. Pat. No. 4,819,904 to Shpigel, et al. Shpigel teaches a conical anchor which, when embedded in the ground, has a screw thread which selectively extends from the surface of the anchor. Shpigel does not teach the use of a plurality of ridges to hold the anchor into the ground. The anchor device of Shpigel has a further problem in that it cannot easily extend its threading in dense material, as opposed to dirt or sand, as the material will resist the lateral pressure of the extension of the threading.

SUMMARY OF THE INVENTION

The present invention does not suffer the prior art problems as it provides an anchoring device which has a plurality of laterally extending baffles which each enter into the ground or a material substantially simultaneously. The present invention has a plurality of laterally extending baffles instead of a single spiraling thread as used in screws. The baffles serve to impede movement of the anchoring device in all directions. Sand, gravel or loose dirt tends to behave like a fluid, and the baffles keep the anchor from being pulled vertically out of the ground, as well as horizontally in any direction. The present invention also has a penetrating tip at its lower end which initially enters frangible material and creates a path of loose debris for the baffles to more easily enter. The penetrating tip also serves to move any hard objects when entering soft material, such as rocks in sand, to allow the baffles to fully contact the soft material.

The primary object of the present invention is to provide an anchoring device which easily embeds into the ground or material yet minimizes slippage within the material due to lateral force being applied to the anchor.

According to the present invention, there is provided an anchoring device comprising a tubular body having an outer surface and an upper end and a tapering lower end, the lower end includes a penetrating tip which has a first tip on the central axis of the tubular body and a plurality of lateral extensions, and a plurality of laterally extending baffles about the outer surface of the tubular body, each of the ridges having a front edge proximal and a rear edge distal to the lower end of the tubular body, whereby rotation of the tubular body translates to axial movement of the anchoring device within a material.

It is another object of the present invention to provide a plurality of laterally extending baffles about the outer surface of the lower end of the anchoring device to firmly embed the anchoring device into the ground with a minimal amount of rotation.

It is a further object of the present invention to provide an anchoring device with a penetrating tip able to push rocks and shells away from the baffles as the anchoring device enters beach sand.

It is yet another object of the present invention to provide an anchoring device with a penetrating tip having lateral extensions which create broken debris for the baffles to embed as the anchoring device rotates through hard material.

It is yet a further object of the present invention to provide an anchoring device that can support pipes or cable without slippage of the anchoring device within the ground.

It is yet another object of the present invention to provide an anchoring device which may secure beach umbrellas within beach sand and can resist extrusion from force exerted on the umbrella by the wind.

It is yet a further object of the present invention to provide an anchoring device which can be rotated and therefore embedded by a drill.

It is yet another object of the present invention to provide an anchoring device made for aluminum or other material which will not corrode from interaction with salt-water.

The above and yet further objects and advantages of the present invention will become apparent from the hereinafter set forth Brief Description of the Drawings, Detailed Description of the Invention, and Claims.

DETAILED DESCRIPTION OF THE INVENTION

Figure 1:
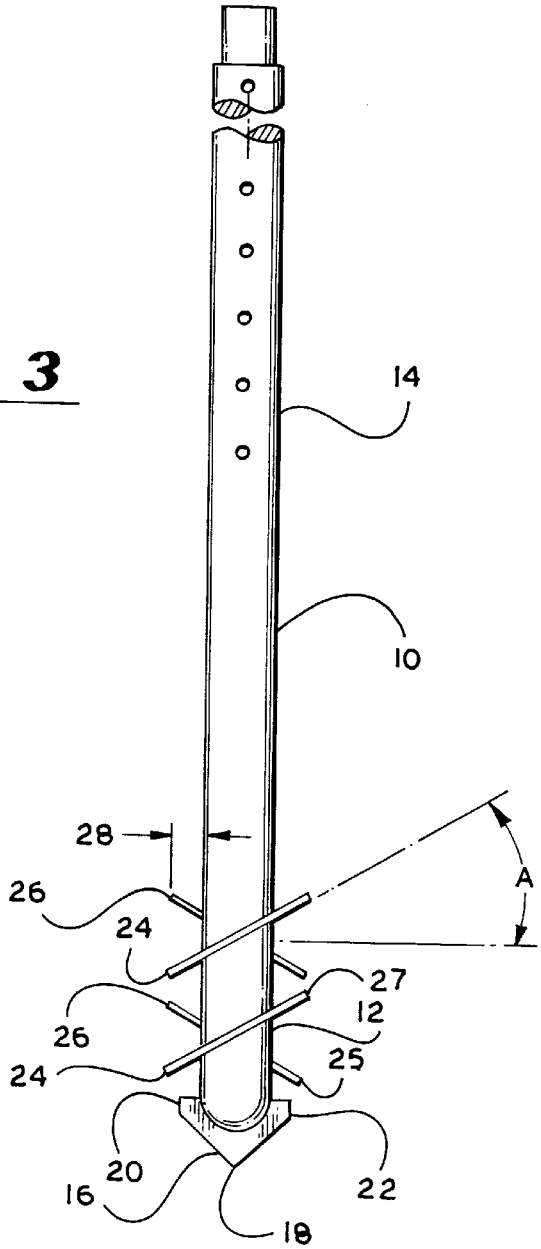
FIG. 1 is a side perspective view of the anchoring device.

An anchoring device 10 is shown in FIG. 1 as having a tubular body with an upper end 14 and a catenoid lower end 12. The lower end 12 includes a penetrating tip 16, shown in FIG. 1 as pentagonal in shape, having a first tip 18 aligned with the axis of the cylindrical body, and lateral extensions 20 and 22 extending laterally from the lower end 12.

About the lower end 12 of the anchoring device 10 are a plurality of discontinuous ridges 22 and 24, here embodied as a set of two pair of substantially parallel ridges. Each ridge of the sets of ridges 24 and 26 have a front edge 25 proximal to the lower end 12 and penetrating tip 16 and are at an angle A forward so that rotation of the anchoring device 10 causes the ridges to enter into the ground. Angle A can be in a range of 2 to 20 degrees, and is optimal at 8 degrees for maximum penetration without imparting significant resistance to the rotation of the anchoring device 10. The sets of ridges 24 and 26 are equidistant from each other such that their respective front edges contact and enter the ground simultaneously. Thus, rotation of the anchoring device 10 cause the sets of ridges 24 and 26 to penetrate and embed simultaneously, offering a distinct advantage over a single continuous-thread screw. The greater resistance to slippage from the sets of ridges 24 and 26 prevents withdrawal or further penetration of the anchor.

Figure 5:
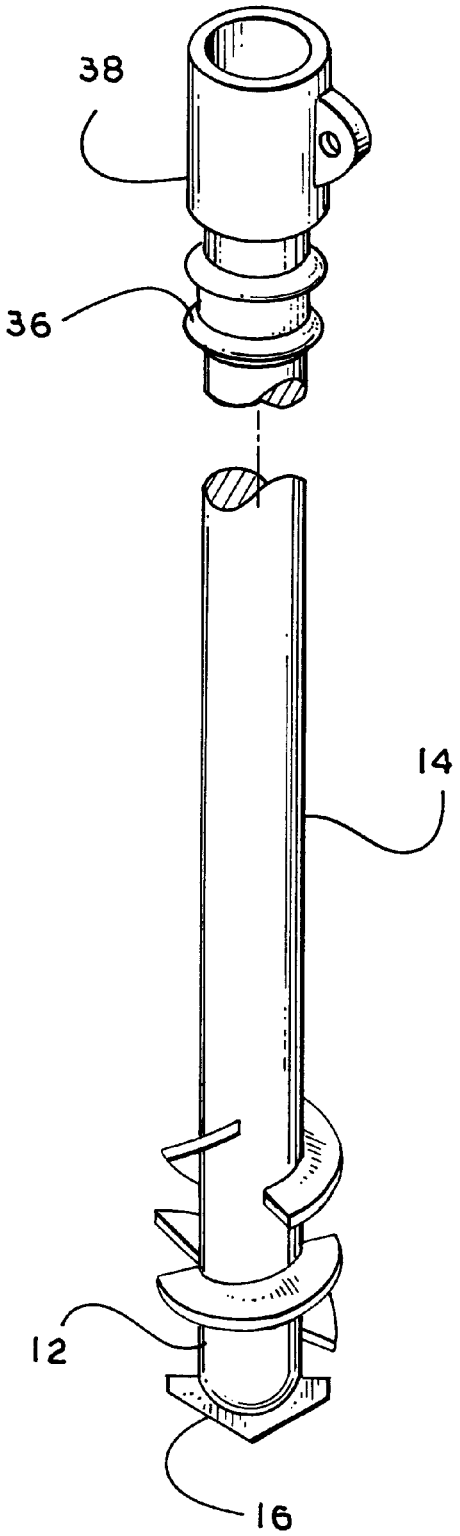
FIG. 5 is a perspective view of the anchoring device with means for securably attaching a beach umbrella at its upper end.

As embodied in FIG. 1 and FIG. 5, the anchoring device is particularly for securing a beach umbrella in beach sand. The cylindrical body 10 is ¾ of an inch in diameter, and the penetrating tip 16 is 1 inch across its base, through the diameter of the tubular body 10. To accomplish firm securement within the sand, the sets of ridges 24 and 26 are ideally raised about ⅝ of an inch from the surface of the anchoring device 10, shown at 28, extending about ½ inch further laterally than the lateral extensions 20 and 22 of the penetrating tip 16. The sets of ridges 24 and 26 are ideally at a 1 inch pitch.

Figure 3:
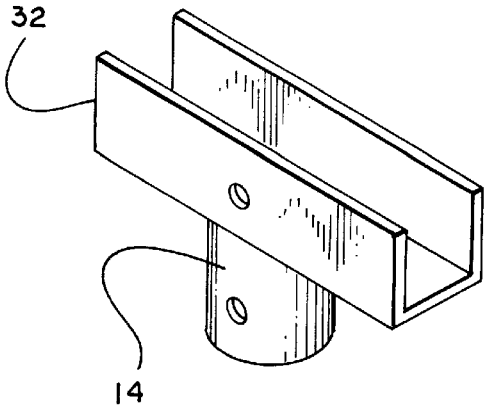
FIG. 3 is a perspective view of the support means for cables rigidly attached to the upper end of the anchoring device.
Figure 2:
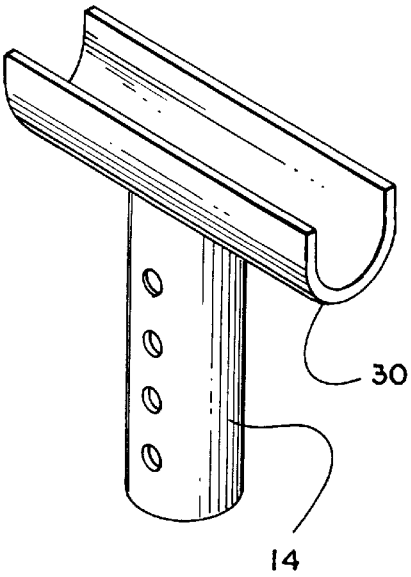
FIG. 2 is a perspective view of the support means for a pipe rigidly attached to the upper end of the anchoring device.

Because of this resistance to further penetration, the present invention is ideal for use in aligning pipes and cables within trenches in the ground before they are covered over with dirt. FIG. 2 illustrates the anchoring device 10 with support means for a pipe 30 at its upper end 14. The support means for the pipe 30 is curved to prevent the pipe from rolling out of the support before the dirt is filled in around it. FIG. 3 likewise shows the anchoring device 10 with support means for cables 32 at its upper end 14. The support means for cables 32 has raised sides to prevent the cables from sliding out prior to and once covered with dirt.

When the anchoring device is embodied as a support for a pipe or cables, it should be constructed from a material such as steel, polyvinylchloride, or other resilient material which resists degradation while buried in the ground. This ensures that the pipes or cable will remain level or at a specified gradient in the ground. The anchoring device may also be sunk in wet concrete to provide a secure, non-tippable support.

Figure 4:
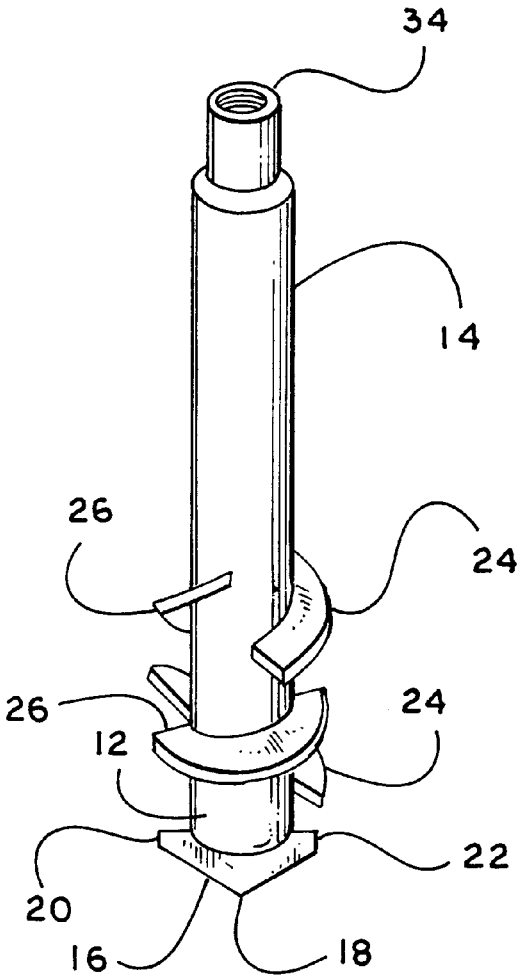
FIG. 4 is a perspective view of the anchoring device with attachment means for a drill at its upper end.

FIG. 4 shows the present invention embodied as an anchor being rotatable by a drill. The anchoring device 10 has a female fitting 34 for the attachment of a drill bit at its upper end 14. In this embodiment, the drill may drive the anchoring device 10 into hard material and the lateral extensions 20 and 22 of the penetrating tip 16 will shape a path slightly narrower in diameter than the lateral extensions of the sets of ridges 24 and 26, creating debris for the sets of ridges 24 and 26 to embed within.

When embodied as an anchor for a beach umbrella, the anchoring device 10 may also includes at its upper end 14 a collar 36, locking ring 42 and socket 38 to receive an umbrella pole 44 of a beach umbrella 46, as shown in FIG. 4 and 5. The socket 38 also includes a handle 40 which allows rotational force to be applied to the anchoring device 10 to embed into the sand. The handle 40 may also serve to secure the umbrella pole 44 into the anchor 10 by providing pressure on the umbrella pole 44 to prevent slippage. In this embodiment, it is preferable that the anchoring device and its components be made from aluminum or other rigid materials which would not corrode through interaction with salt-water.

Figures 6, 7, 8:
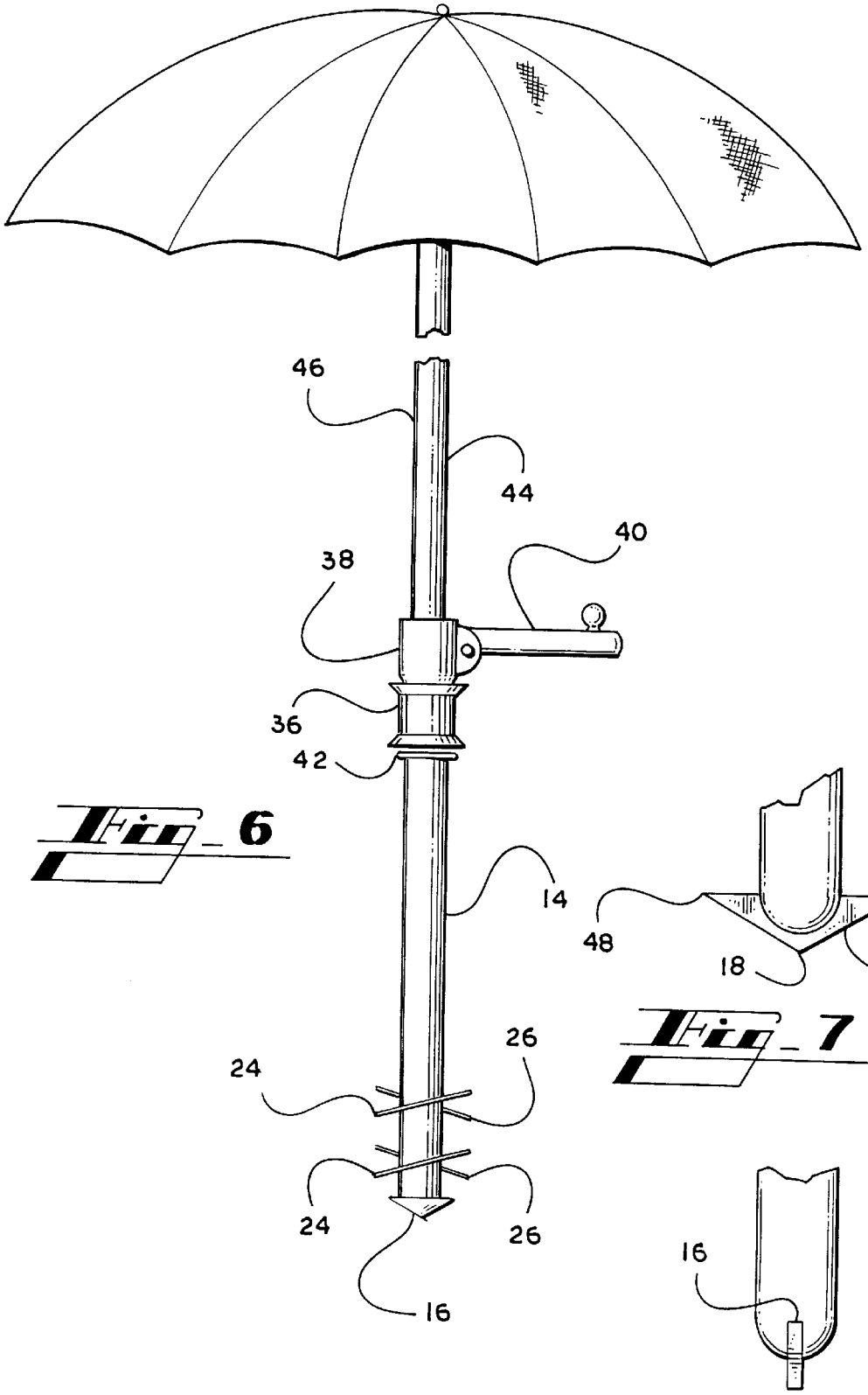
FIG. 6 is a perspective view of a beach umbrella inserted into the anchoring device.
FIG. 7 is a front view of a triangular penetrating tip.
FIG. 8 is a side view of a triangular penetrating tip.

As shown in FIG. 7 and FIG. 8, the penetrating tip 16 of the beach umbrella anchor embodiment is triangular, with the tips of the triangle constituting the lateral extensions 48 and 50. The lateral extensions 48 and 50 push hard objects, such as shells and rocks, from the path of the anchoring device 10 as it enters into the beach sand. This allows the ridges to completely contact and embed in the sand with no gaps being caused by shells or rocks, which gives the greater resistance to dislodging. Thus, the beach umbrella anchor withstands the tremendous force wind may exert on the beach umbrella without dislodging from the sand.

While there has been shown the preferred and alternate embodiments and uses for the present invention, it is to be appreciated that certain changes may be made in the arrangement and forms of the elements of the present invention without departing from the spirit of the invention as set forth the claims.

What is claimed is:

1. An anchoring device, comprising:

a tubular body having an outer surface and an upper end and a tapering lower end;

said lower end including a penetrating tip extending longitudinally from said tubular body, said penetrating tip further having a plurality of lateral extensions capable of breaking hard ground; and a plurality of laterally extending baffles about said outer surface of said tubular body, each of said baffles having a front edge proximal and a rear edge distal to said lower end of said tubular body, each of said front edges being substantially the same distance on said outer surface of said body relative to each other and distally from said penetrating tip, whereby rotation of said tubular body causes said lateral extensions of said penetrating tip to break the ground preceding said front edges of said baffles and which translates to substantially simultaneous axial movement of said baffles of the anchoring device within the ground.

2. The anchoring device as recited in claim 1, wherein said plurality of baffles are each a set of two substantially parallel lateral extensions set along approximately one half of the circumference of said body.

3. The anchoring device as recited in claim 2, wherein said baffles are angled downward from said rear edge to said front edge in a range of 2 to 20 degrees, with 8 degrees being optimal.

4. The anchoring device as recited in claim 3, wherein said baffles are each extending ⅝ of an inch laterally from said tubular body and having a 1 inch pitch.

5. The anchoring device as recited in claim 4, wherein said tubular body, said penetrating tip, and said baffles are aluminum.

6. The anchoring device as recited in claim 4, further including means at said upper end of said tubular body for attaching a drill bit to rotate and embed said baffles.

7. An anchoring device, comprising:

a tubular body having an outer surface and an upper end and a substantially catenoid lower end;

said lower end including a substantially pentagonal penetrating tip extending through the diameter thereof, said penetrating tip having a first tip on the central axis of said tubular body, said penetrating tip further having a pair of lateral extensions comprised of a second and third, and fourth and fifth tips; and a plurality of sets of substantially parallel laterally extending baffles about said outer surface of said lower end of said tubular body, each of said baffles having a front edge proximal and a rear edge distal to said lower end of said tubular body, each of said front edges being substantially the same distance on said outer surface of said body relative to each other and distally from said penetrating tip, and each of said sets being approximately equidistant from the other about said outer surface of said tubular body, whereby rotation of said tubular body causes said lateral extensions of said penetrating tip to break the material preceding said front edges of said baffles and which translates to axial movement of the anchoring device within a material.

8. The anchoring device as recited in claim 7, wherein each of said plurality of sets of substantially parallel baffles is two.

9. The anchoring device as recited in claim 8, wherein said baffles are angled downward from said rear edge to said front edge in a range of 2 to 20 degrees, with 8 degrees being optimal.

10. The anchoring device as recited in claim 9, wherein said baffles are each extending ⅝ of an inch laterally from said tubular body and having a 1 inch pitch.

11. The anchoring device as recited in claim 10, wherein said tubular body, said penetrating tip, and said baffles are aluminum.

12. The anchoring device as recited in claim 10, further including means at said upper end of said tubular body for attaching a drill bit to rotate and embed said sets of baffles.

* * * * *